US010857444B1

(12) United States Patent
Holden

(10) Patent No.: US 10,857,444 B1
(45) Date of Patent: Dec. 8, 2020

(54) RETRACTABLE SPORTS ACTIVITY DEVICE

(71) Applicant: Arthur Aaron Holden, Shorewood, IL (US)

(72) Inventor: Arthur Aaron Holden, Shorewood, IL (US)

( * ) Notice: Subject to any disclaimer, the term of this patent is extended or adjusted under 35 U.S.C. 154(b) by 0 days.

(21) Appl. No.: 16/922,116

(22) Filed: Jul. 7, 2020

Related U.S. Application Data

(60) Provisional application No. 62/989,917, filed on Mar. 16, 2020.

(51) Int. Cl.

| | |
|---|---|
| ***A63B 67/00*** | (2006.01) |
| ***A63B 69/00*** | (2006.01) |
| ***A63B 71/02*** | (2006.01) |
| ***A63B 71/06*** | (2006.01) |
| ***E06B 9/54*** | (2006.01) |
| *A63B 63/00* | (2006.01) |

(52) U.S. Cl.
CPC ..... *A63B 71/022* (2013.01); *A63B 71/0622* (2013.01); *E06B 9/54* (2013.01); *A63B 2063/006* (2013.01); *A63B 2210/58* (2013.01)

(58) Field of Classification Search
CPC ..... A63B 71/022; A63B 71/0622; A63B 2063/006; A63B 2210/58; E06B 9/54
USPC ..... 473/415, 421, 422, 151, 197, 465, 435, 473/439, 454, 462
See application file for complete search history.

(56) References Cited

U.S. PATENT DOCUMENTS 4,153,246 A * 5/1979 Byrne ..... A63B 63/00 473/197
4,180,352 A * 12/1979 Divers ..... E21F 1/14 160/330
4,183,524 A * 1/1980 Kifferstein ..... A63B 63/00 473/197
5,007,645 A * 4/1991 Weigl ..... A63B 63/00 473/421
5,116,056 A * 5/1992 Schmutte ..... A63B 63/00 473/421
5,277,430 A * 1/1994 Naccarato ..... A63B 63/00 473/446
5,409,230 A * 4/1995 Dunaway ..... A63B 69/3676 473/160
5,571,266 A * 11/1996 Nichols ..... A63B 63/00 473/446
5,664,784 A * 9/1997 Redlich ..... A63B 63/00 473/476

(Continued)

*Primary Examiner* — Mitra Aryanpour
(74) *Attorney, Agent, or Firm* — Donald J. Ersler

(57) ABSTRACT

An retractable sports activity device preferably includes a left rail bracket, a right rail bracket, a media reel and a bottom media support. The left and right rail brackets are attached to left and right garage door roller rails, or a wall or a ceiling. The media reel preferably includes a reel tube, a sheet media and a retractable shield unit. Opposing ends of the reel tube are rotatably retained by the left and right rail brackets. A top of the sheet media is secured to the reel tube. The retractable shield unit preferably includes a left shield unit, a right shield unit and a top shield. The left shield unit is retained on a left end of the reel tube and the right shield unit is retained on a right end of the reel tube. A bottom of the sheet media is support by the bottom media support.

17 Claims, 12 Drawing Sheets

(56) References Cited

U.S. PATENT DOCUMENTS

| | | | | | |
|---|---|---|---|---|---|
| 5,725,444 | A * | 3/1998 | Heden | A63B 63/00 | 473/446 |
| 5,876,291 | A * | 3/1999 | Dubose | A63B 63/00 | 473/197 |
| 5,947,831 | A * | 9/1999 | McCarthy | A63B 63/00 | 473/197 |
| 5,993,334 | A * | 11/1999 | McNamara | A63B 63/00 | 473/446 |
| 6,969,068 | B1 * | 11/2005 | Pollon | A63B 63/00 | 473/476 |
| 7,293,776 | B2 * | 11/2007 | Fenwick | A63B 63/00 | 473/446 |
| 9,289,673 | B1 | 3/2016 | Allen | | |
| 9,623,306 | B1 * | 4/2017 | Walker | A63B 69/00 | 473/476 |
| 10,080,948 | B2 * | 9/2018 | Manieri | A63B 71/022 | 473/476 |
| 10,258,852 | B1 * | 4/2019 | Walker | A63B 71/022 | 473/476 |
| 2012/0322567 | A1 * | 12/2012 | Manieri | A63B 69/36 | 473/197 |

* cited by examiner

RETRACTABLE SPORTS ACTIVITY DEVICE

CROSS-REFERENCE TO RELATED APPLICATIONS

This a nonprovisional patent application, which claims the benefit of provisional patent application No. 62/989,917 filed on Mar. 16, 2020.

BACKGROUND OF THE INVENTION

Field of the Invention

The present invention relates generally to sports and more specifically to a retractable sports activity device, which is attachable to garage door roller rails, a wall or a ceiling for the practice of golf, baseball or the like.

Discussion of the Prior Art

U.S. Pat. No. 4,153,246 to Byrne discloses a sports net. U.S. Pat. No. 5,007,645 to Weigl et al. discloses a golf practice device. U.S. Pat. No. 9,289,673 to Allen discloses a golf cage system. uninterruptible power to a PoE device in a powered state.

Accordingly, there is a clearly felt need in the art for a retractable sports activity device, which is attachable to garage door roller rails, while allowing the garage door to be used, and which also may attached to a wall or a ceiling for the practice of golf, baseball or the like. Finally, the retractable sports activity device may be retracted for the use of floor space below.

SUMMARY OF THE INVENTION

The present invention provides a retractable sports activity device, which is attachable to garage door roller rails, a wall or a ceiling. The retractable sports activity device preferably includes a left rail bracket, a right rail bracket, a media reel, a bottom media support and an image projector. The left rail bracket and the right rail bracket are preferably mirror images of each other. Each rail bracket preferably includes a rail retention member and a reel slot bracket. A top portion of the rail retention member is attached to a roller rail of a garage door. The reel slot bracket is attached to a side portion of the rail retention member with a plurality of spacers and fasteners. The reel slot bracket includes a reel slot for retaining one end of the media reel. The media reel preferably includes a reel tube, a plurality of attachment clamps, a sheet media and a retractable shield unit. Opposing ends of the reel tube are rotatably retained by the left and right rail brackets. The plurality of attachment clamps are attached along a length of the reel tube to retain a top of the sheet media. The sheet media includes a plurality of loops along a top and a bottom. The top of the sheet media is secured to the plurality of attachment clamps with the plurality of top loops. The sheet media may be a net or a projector screen.

The retractable shield unit preferably includes a left shield unit, a right shield unit and a top shield. The left shield unit is retained on a left end of the reel tube and the right shield unit is retained on a right end of the reel tube. Each shield unit includes a base member, a retraction arm, an opener device and a screen sheet. The base member is attached to the reel tube. One end of the retraction arm is pivotally engaged with an end of the base member. One end of the opener device is attached to the base member and an opposing end of the opener device is attached to an opposing end of the retraction arm. A rear of the top shield is secured to a top of the sheet media. A left end of the top shield is attached to a top of a left screen sheet. A right end of the top shield is attached to a top of a right screen sheet. A top of a left screen sheet is attached to a left retraction arm. A length of the left screen sheet is attached to a left end of the sheet media. A top of a right screen sheet is attached to a right retraction arm. A length of the right screen sheet is attached to a right end of the sheet media.

The bottom media support includes a left support, a right support and a pole. The left support and the right support each preferably include a support base and an upright member. A plurality of holes are formed through the upright member to receive the pole. The pole is supported on each end by the left and right supports. The plurality of holes have different vertical heights to position the pole at different heights from a support surface. The pole preferably includes a plurality of rings for attachment of a bottom the sheet media. An image projector is used to project an image on to the sheet media, if the sheet media is a projector screen.

Accordingly, it is an object of the present invention to provide a retractable sports activity device, which is attachable to garage door roller rails, while allowing the garage door to be used, and which also may attached to a wall or a ceiling for the practice of golf, baseball or the like.

Finally, it is an objection of the present invention to provide a retractable sports activity device, which may be retracted to provide floor space below.

These and additional objects, advantages, features and benefits of the present invention will become apparent from the following specification.

DETAILED DESCRIPTION OF THE PREFERRED EMBODIMENTS

Figure 1:
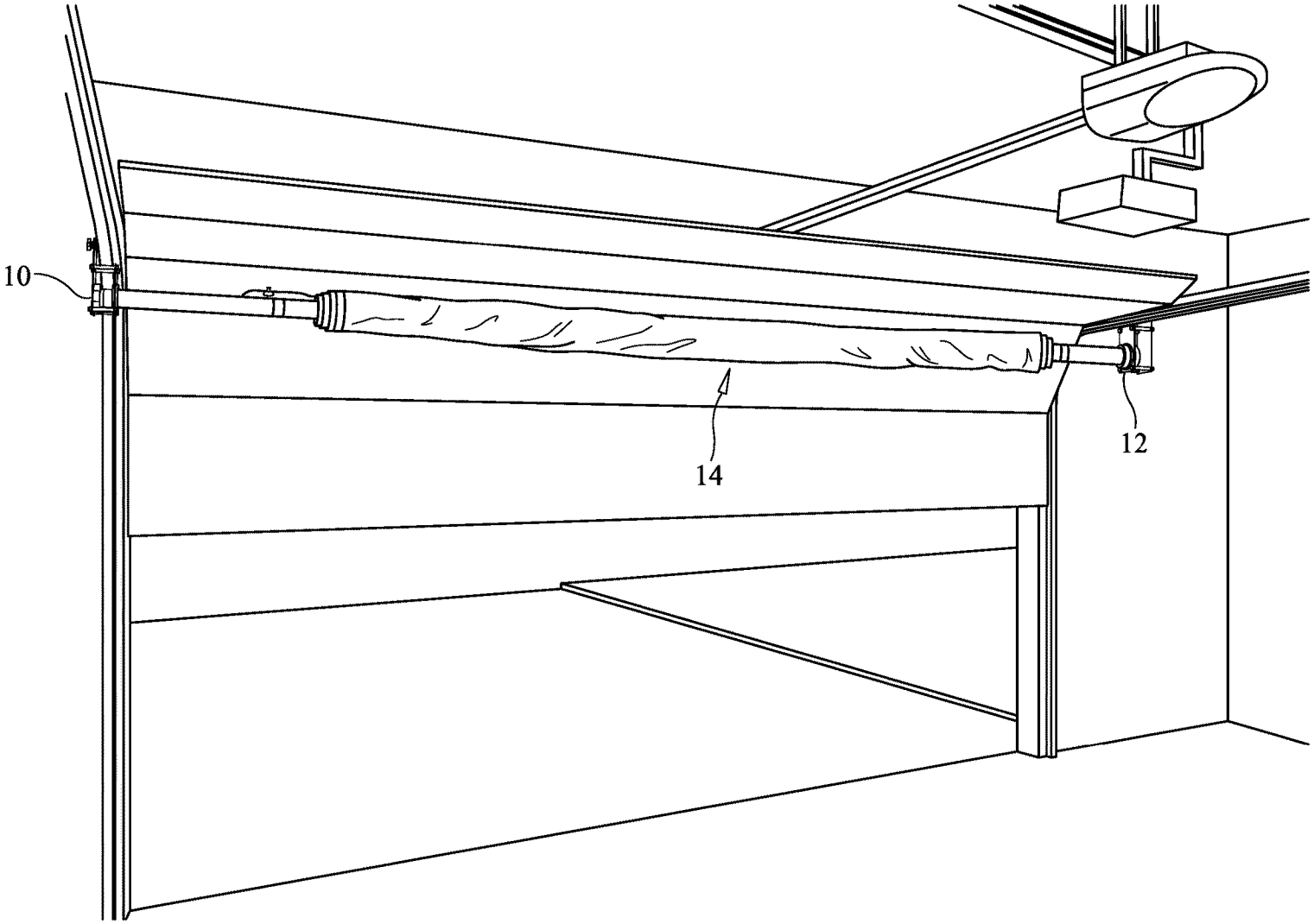
FIG. 1 is a perspective view of a retractable sports activity device mounted to garage door roller rails in a garage, before unrolling in accordance with the present invention.
Figure 2:
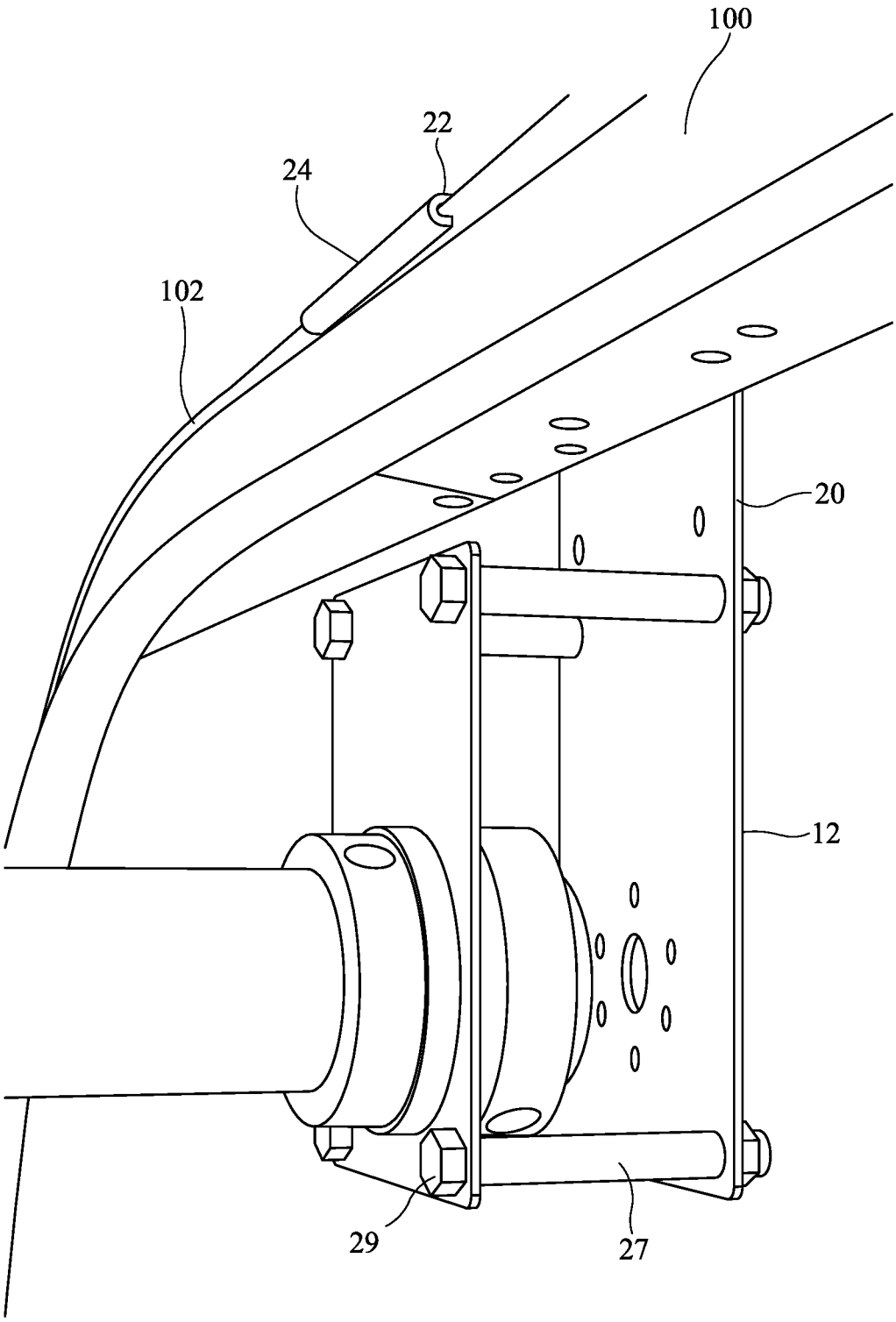
FIG. 2 is a perspective view of a right rail bracket of a retractable sports activity device mounted to garage door roller rail in accordance with the present invention.
Figure 2A:
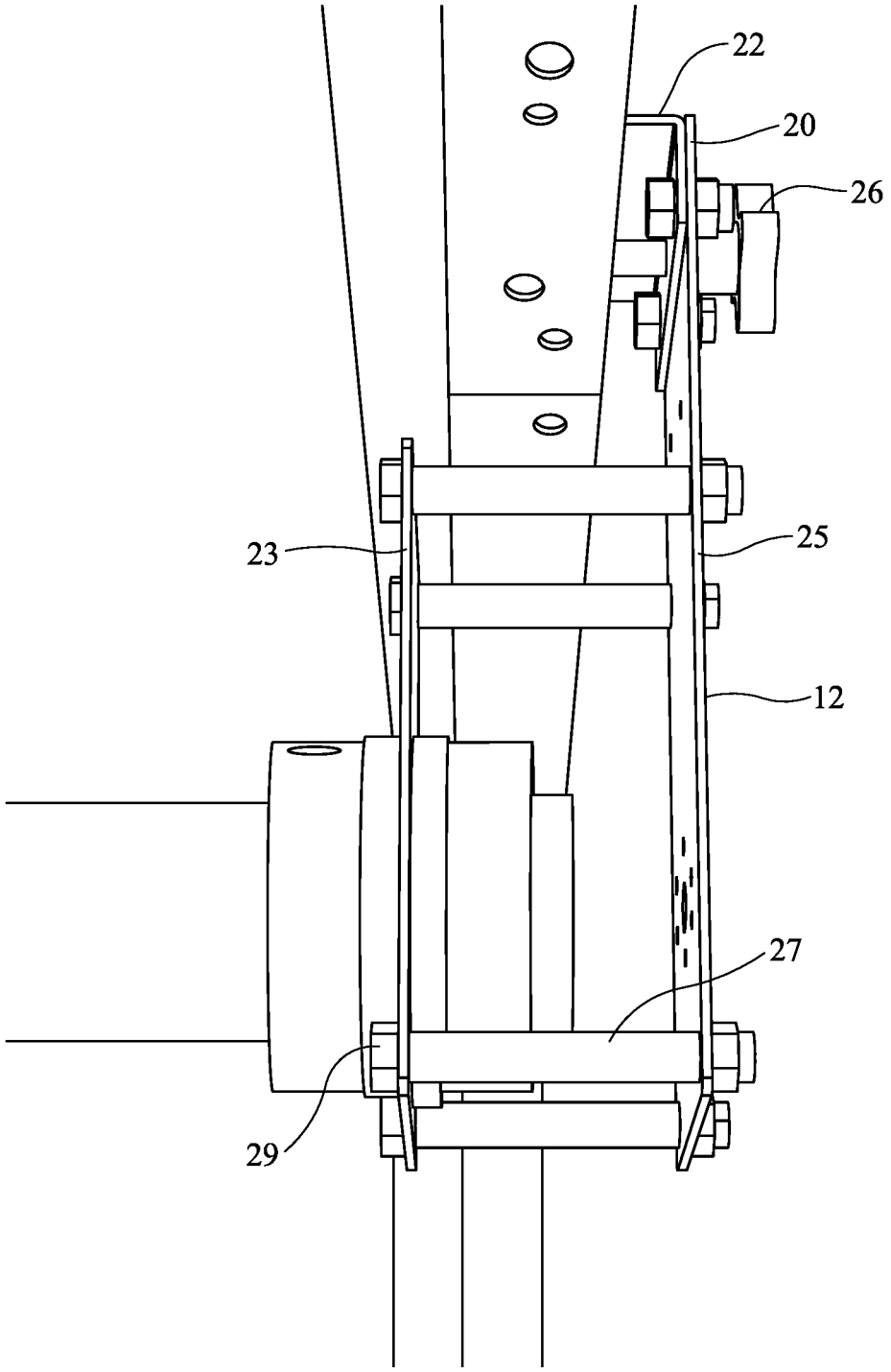
FIG. 2*a* is a bottom perspective view of a right rail bracket of a retractable sports activity device mounted to a right garage door roller rail in accordance with the present invention.
Figure 4:
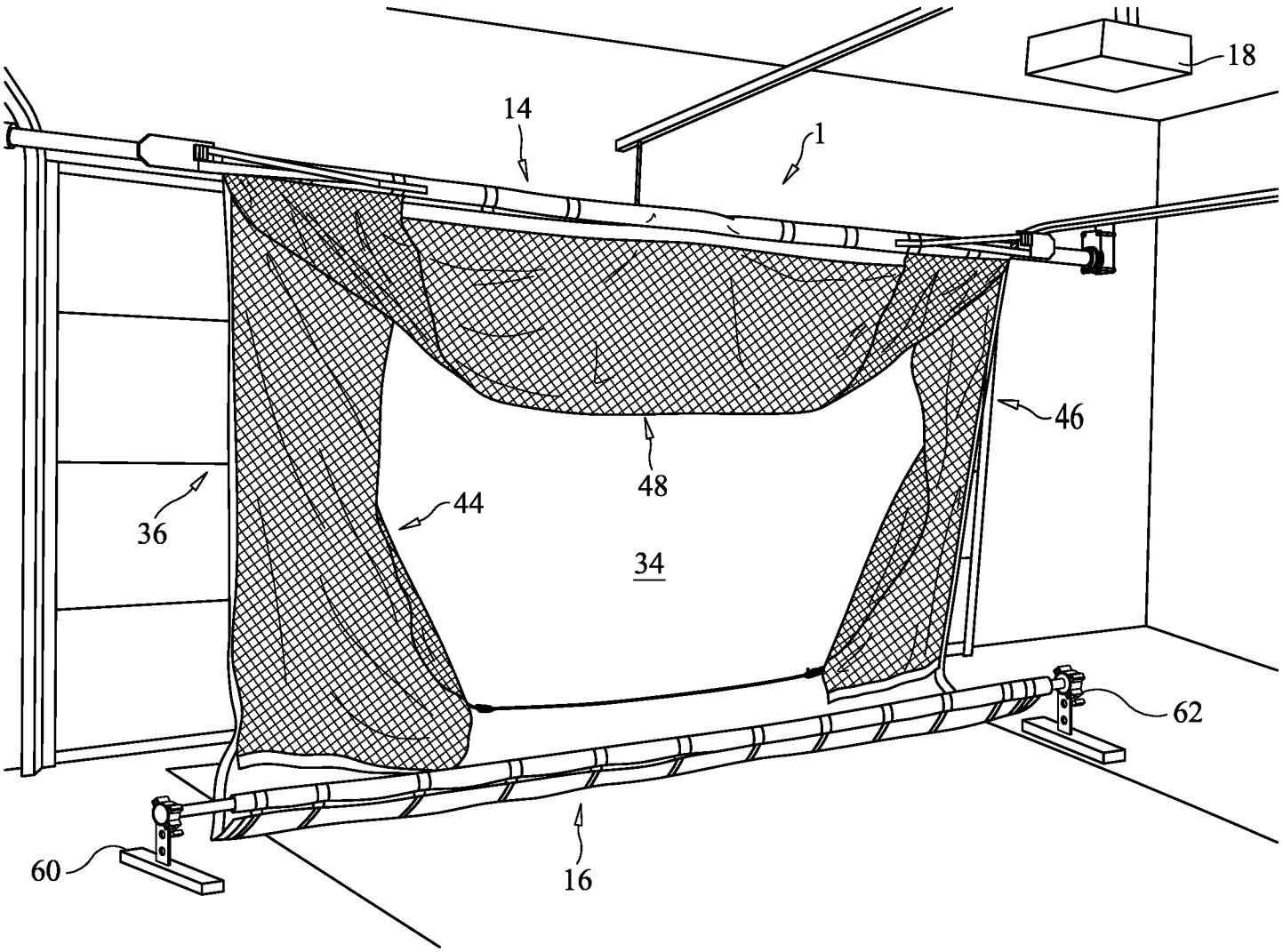
FIG. 4 is a perspective view of a retractable sports activity device in a garage, which is fully unrolled in accordance with the present invention.
Figure 9:
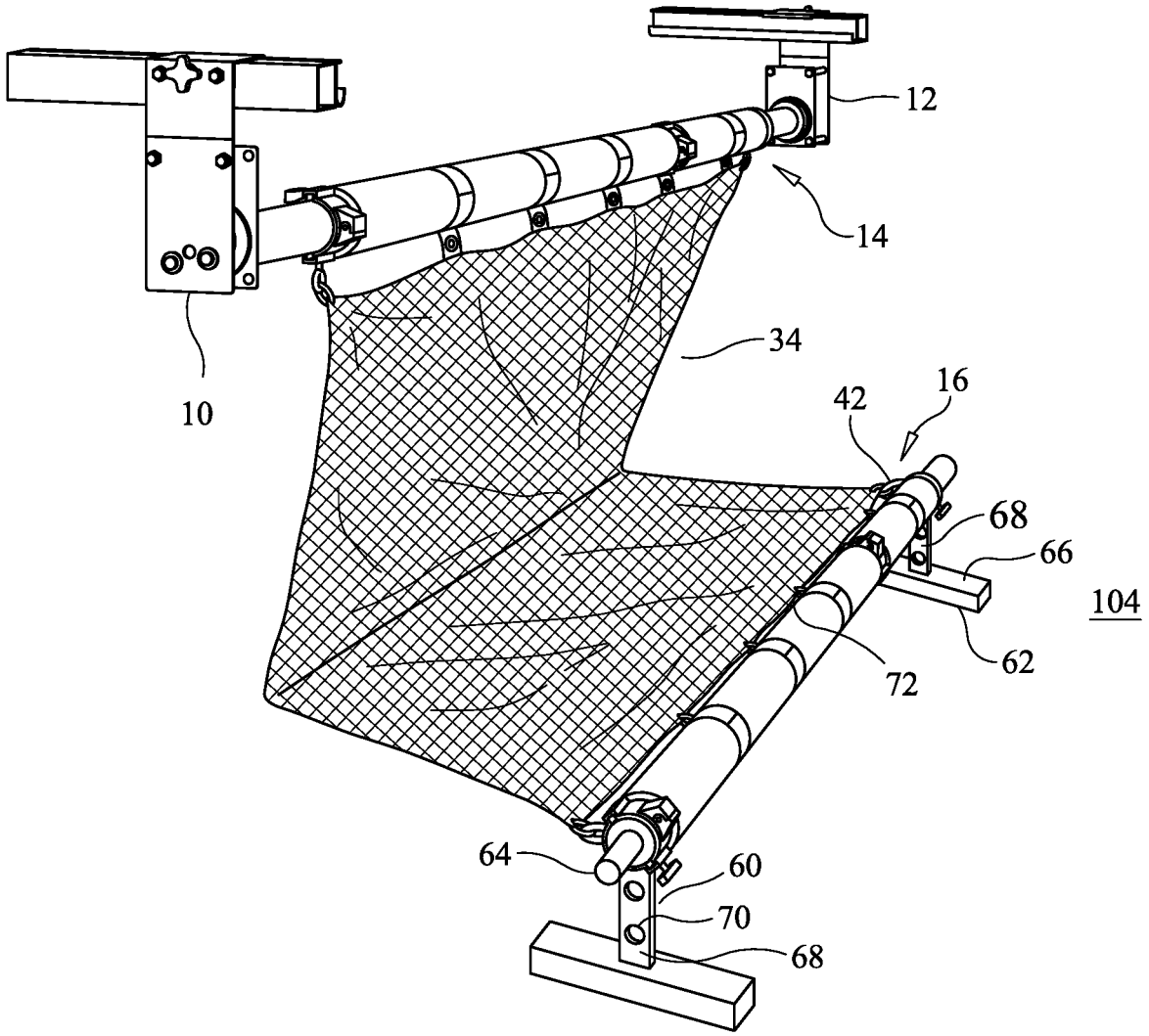
FIG. 9 is a perspective view of a retractable sports activity device installed on display device without a retractable shield unit in accordance with the present invention.

With reference now to the drawings, and particularly to FIG. 1, there is shown a retractable sports activity device 1. With reference to FIGS. 2, 4 and 9, the retractable sports activity device 1 preferably includes a left rail bracket 10, a right rail bracket 12, a media reel 14, a bottom media support 16 and an image projector 18. With reference to FIGS. 2, 2*a*, 2*b* and 9, the left rail bracket 10 and the right rail bracket 12 are preferably mirror images of each other. Each rail bracket 10, 12 preferably includes a rail retention member 20 and a reel slot bracket 23. A top portion 22 of the rail retention member 20 includes a hook end 24 and a clamp screw 26. The hook end 24 is sized to receive a top rail 102 of a garage door roller rail 100. The clamp screw 26 is threadably engaged with side portion 25 of the rail retention member 20 to retain the left and right rail brackets 10, 12 on the garage door roller rails 100. The reel slot bracket 23 is attached to the side portion 25 of the rail retention member 20 with a plurality of spacers 27 and fasteners 29. The reel slot bracket 23 includes a reel slot 28 for retaining one end of the media reel 14. However, the left and right rail brackets may also be mounted to wall or a ceiling.

Figure 2B:
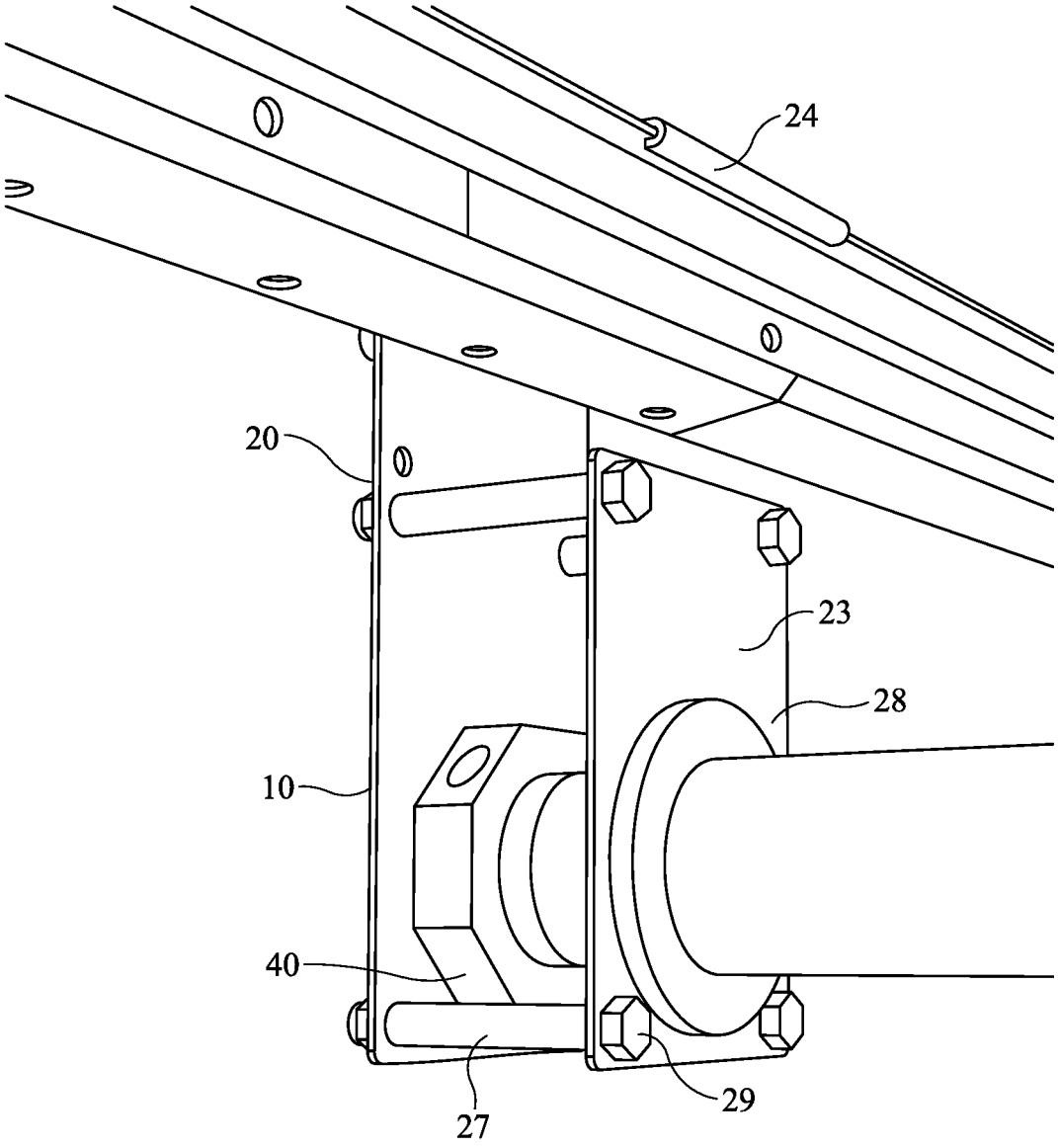
FIG. 2*b* is a perspective view of a left rail bracket of a retractable sports activity device mounted to a left garage door roller rail in accordance with the present invention.
Figure 3:
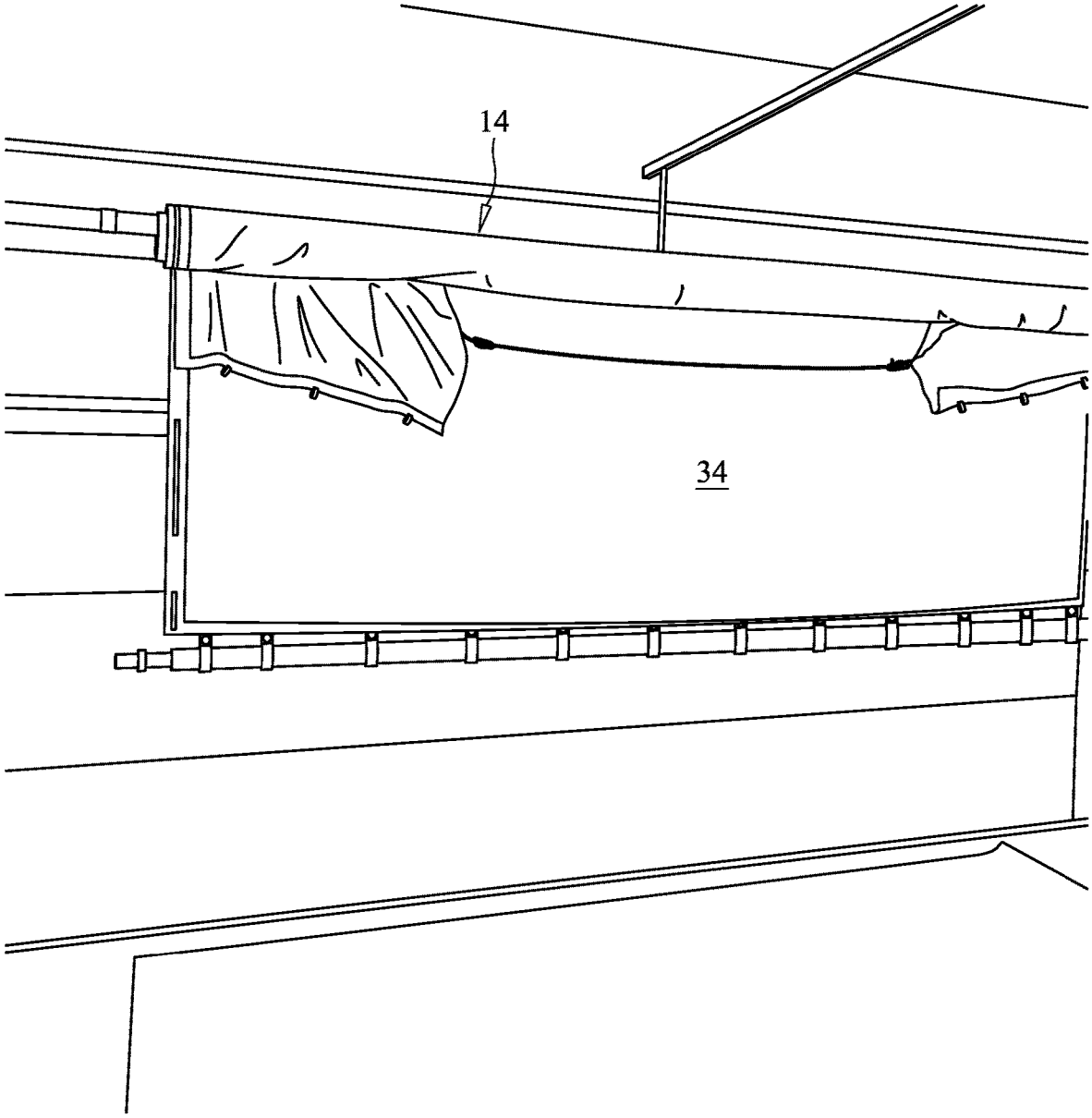
FIG. 3 is a perspective view of a retractable sports activity device in a garage, which is partially unrolled in accordance with the present invention.
Figure 7:
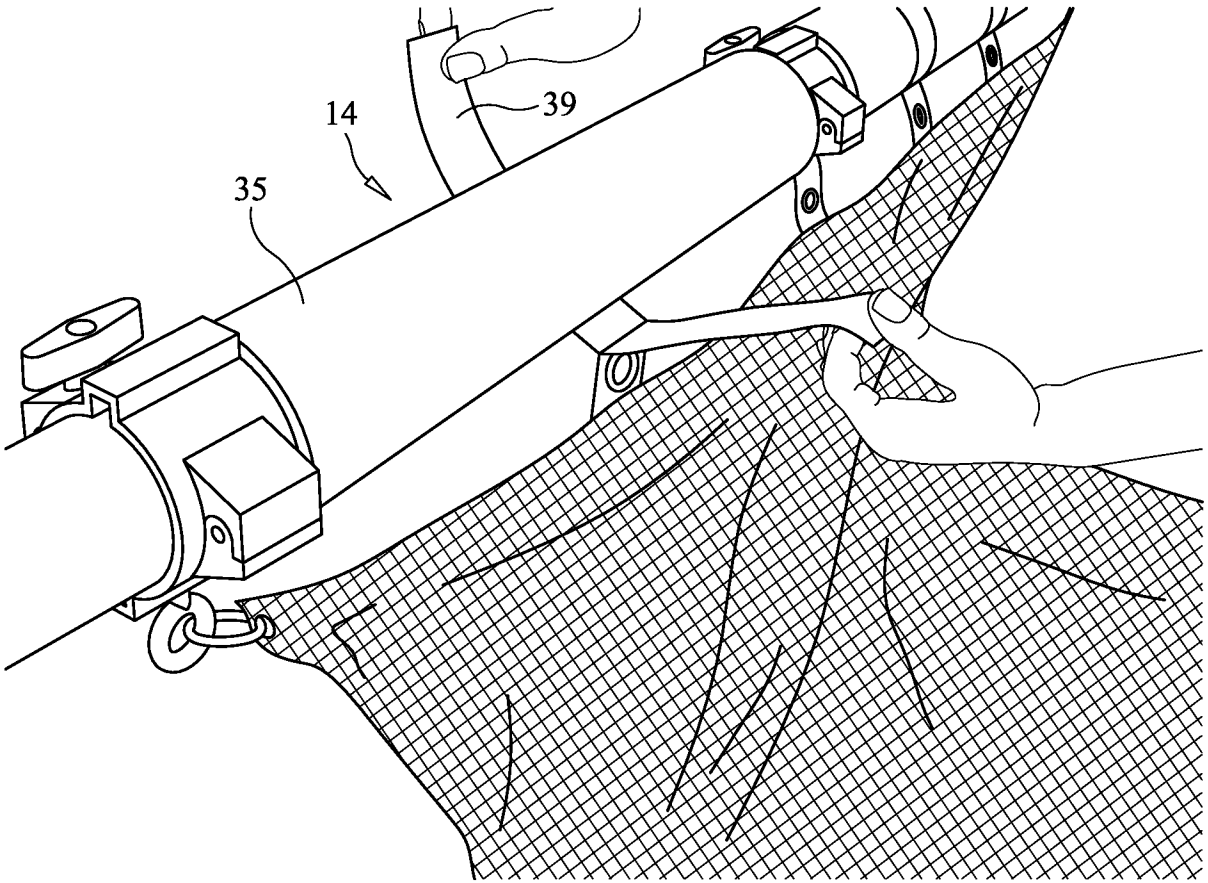
FIG. 7 is a close-up perspective view of a media reel with a sheet media attached thereto of a retractable sports activity device without a retractable shield unit in accordance with the present invention.
Figure 8:
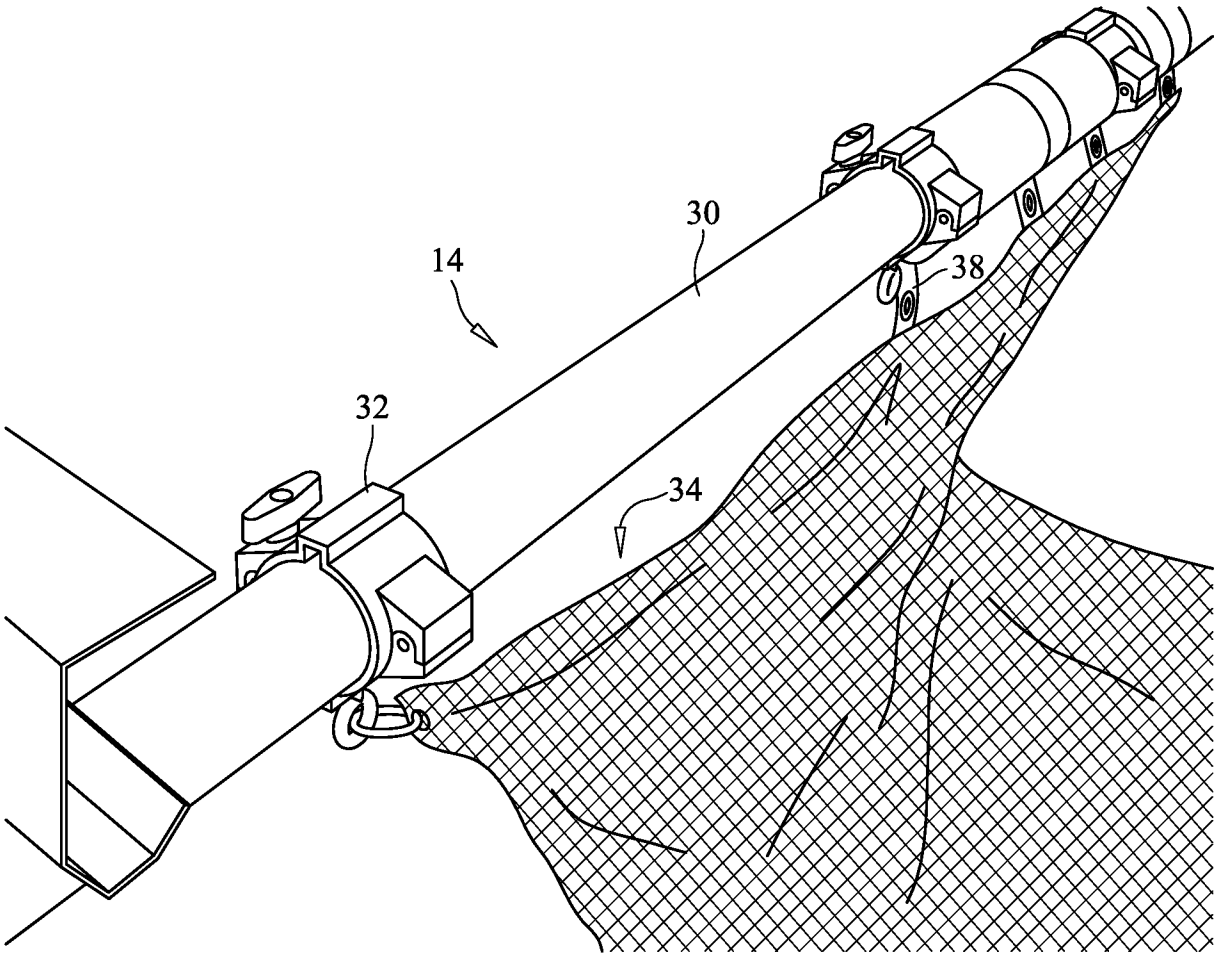
FIG. 8 is a close-up perspective view of a media reel with a sheet media attached thereto and a styrene wrap removed to reveal a reel tube of a retractable sports activity device without a retractable shield unit in accordance with the present invention.

With reference to FIGS. 3, 4 and 8, the media reel 14 preferably includes a reel tube 30, a plurality of attachment clamps 32, a sheet media 34 and a retractable shield unit 36. The sheet media 34 may be a projection screen, a net or any other suitable sheet. Opposing ends of the reel tube 30 are rotatably retained by the left and right rail brackets 10, 12. With reference to FIG. 2*b*, an electric motor 40 may be used to roll and unroll the media reel 14. However, the media reel 14 may be rolled and unrolled manually. The plurality of attachment clamps 32 are attached along a length of the reel tube 30 to retain the sheet media 34. With reference to FIG. 7, a plurality of spacer pads 35 may be used to equalize a perimeter of the plurality of attachment clamps 32 relative to the reel tube 30. The sheet media 34 includes a top plurality of loops 38 and a plurality of bottom loops 42. The top of the sheet media 34 is secured to the plurality of attachment clamps 32 with the plurality of top loops 38. The sheet media 34 may also be secured to the media reel 14 with VELCRO® strip 39 or the like. The sheet media 34 may be a net or a projector screen.

Figure 5:
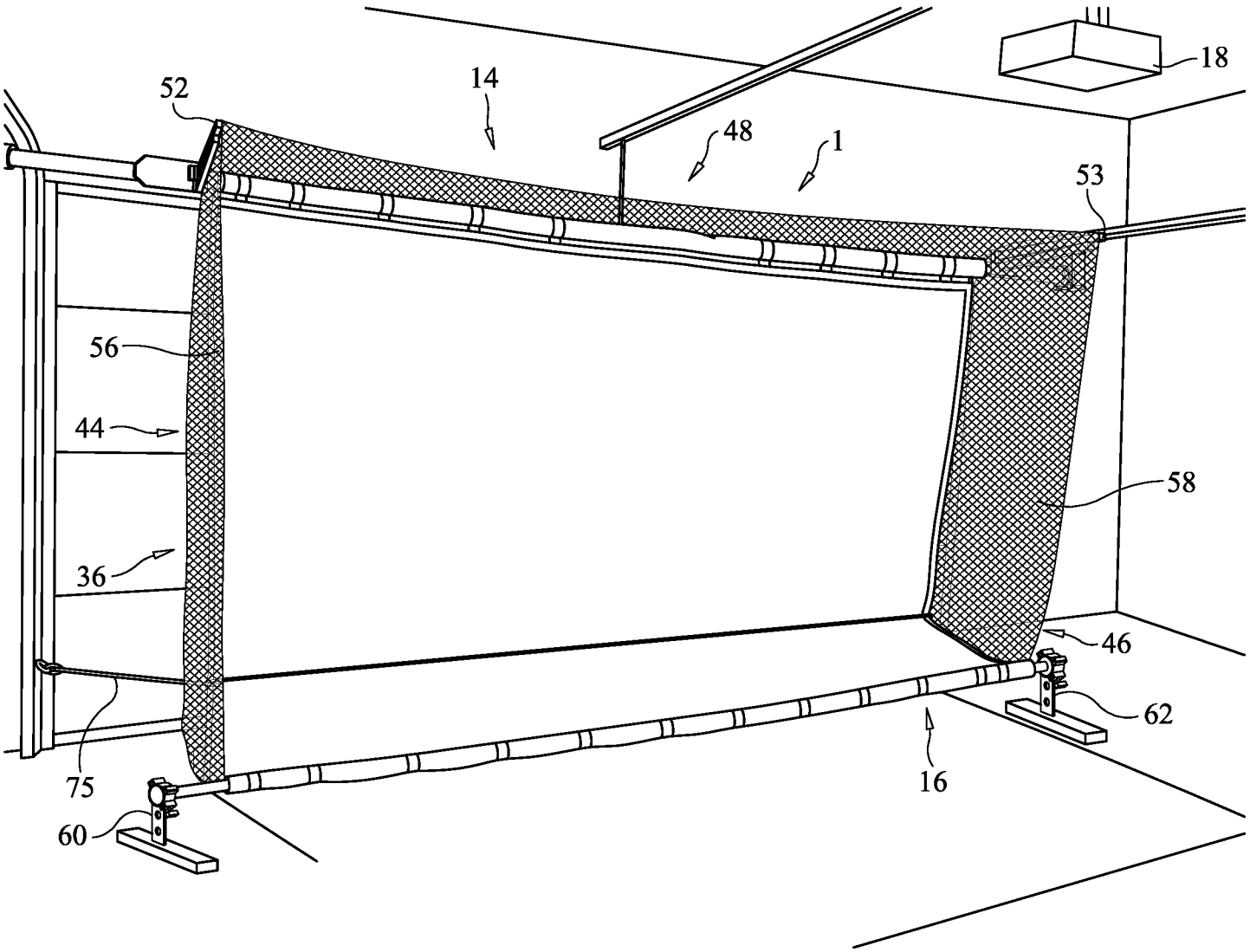
FIG. 5 is a perspective view of a retractable sports activity device in a garage, which is fully unrolled and a retractable shield unit fully stretched in accordance with the present invention.
Figure 6:
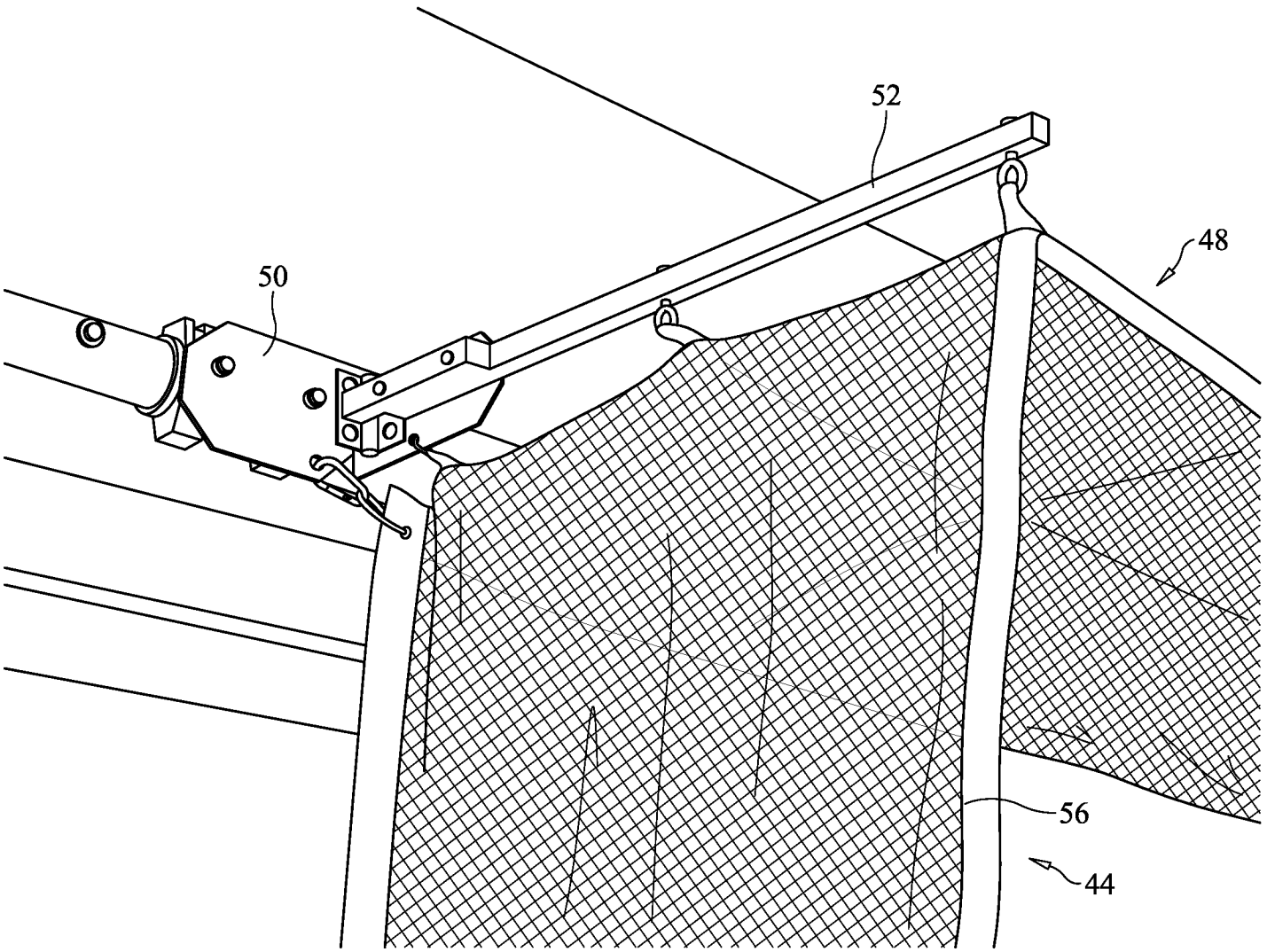
FIG. 6 is a close-up perspective view of a portion of a left shield unit of a fully deployed retractable shield unit of a retractable sports activity device in accordance with the present invention.

With reference to FIGS. 4-6, the retractable shield unit 36 preferably includes a left shield unit 44, a right shield unit 46 and a top shield 48. The left shield unit 44 is retained on a left end of the reel tube 30 and the right shield unit 46 is retained on a right end of the reel tube 30. Each shield unit 44, 46 includes a base member 50, a retraction arm 52, 53 and a screen sheet 56, 58. The base member 50 is attached to the reel tube 30. One end of the retraction arm 52 is pivotally engaged with an end of the base member 50. One end of the opener device 54 is attached to the base member 50 and an opposing end of the opener device 54 is attached to an opposing end of the retraction arm 52. The opener device 54 may be an extension spring, a screen door closer, torque hinge, tension hinge or actuator. A rear of the top shield 48 is secured to a top of the sheet media 34. A left end of the top shield 48 is attached to a top of a left screen sheet 56. A right end of the top shield 48 is attached to a top of a right screen sheet 58. A top of the left screen sheet 56 is attached to a left retraction arm 52. A length of the left screen sheet 56 is attached to a left end of the sheet media 34. A top of a right screen sheet 58 is attached to a right retraction arm 53. A length of the right screen sheet 58 is attached to a right end of the sheet media 34.

With reference to FIG. 9, the bottom media support 16 includes a left support 60, a right support 62 and a pole 64. The left support 60 and the right support 62 each preferably include a support base 66 and an upright member 68. A plurality of holes 70 are formed through the upright member 68 to receive opposing ends of the pole 64. The plurality of holes 70 have different vertical heights to position the pole 64 at different heights from a support surface 104. The pole 64 preferably includes a plurality of rings 72 for attachment of a bottom the sheet media 34. With reference to FIG. 5, a bungie cord 75 or the like is used to pull the sheet media 34 back. With reference to FIG. 5, one end of the bungie cord 75 is attached to a bracket on the outside of the garage door roller rails 100 and the other end thereof to the left screen sheet 56 or the right screen sheet 58.

Figure 10:
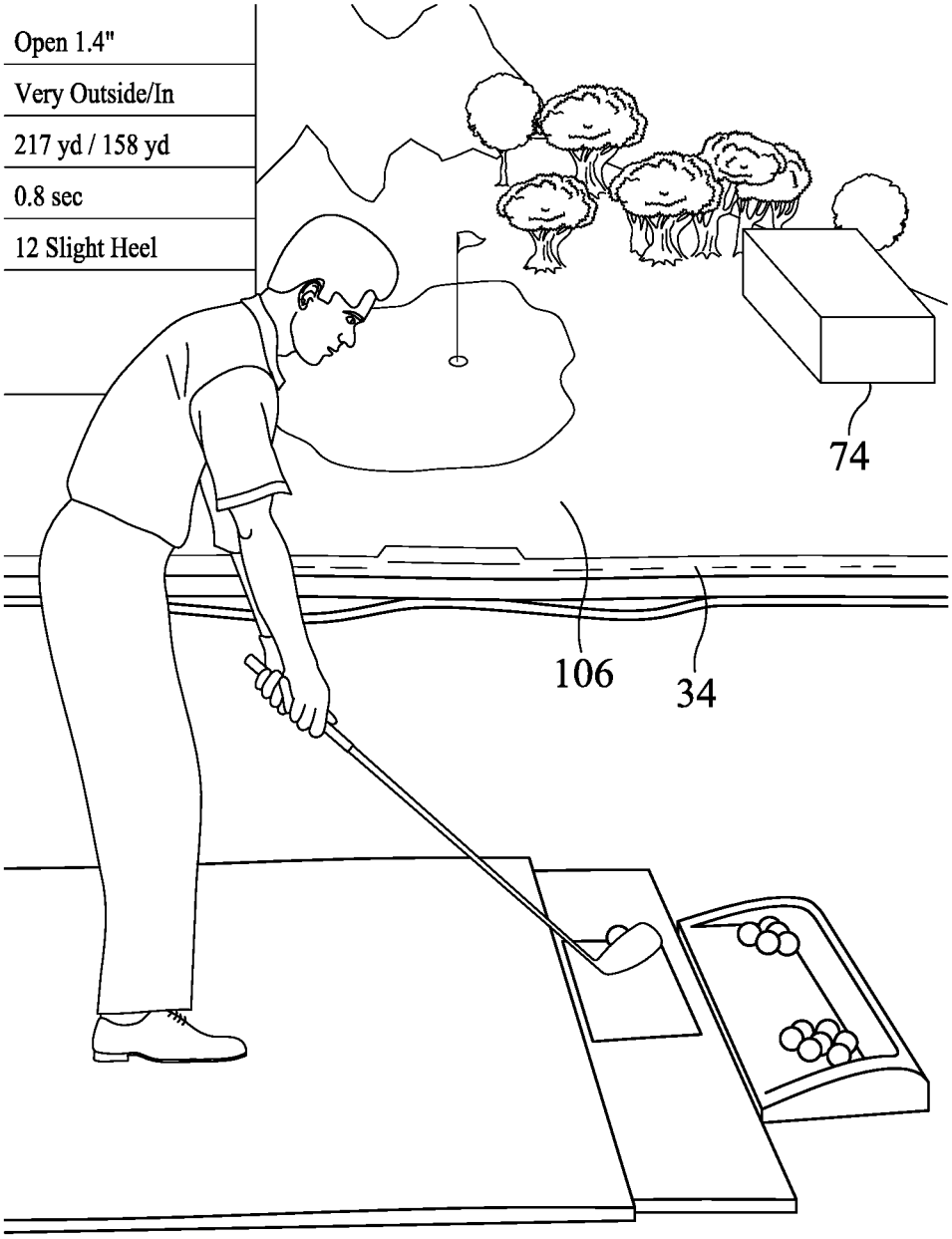
FIG. 10 is a perspective view of a retractable sports activity device with a projector screen and an image projected on the projector screen for practicing golf in accordance with the present invention.

With reference to FIG. 10, an image projector 74 is used to project an image 106 on to the sheet media 34, if the sheet media 34 is a projector screen.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A retractable sports activity device for retention on a left roller rail and a right roller rail of a garage door, for retention on left and right garage door roller rails of a garage, comprising:

a left rail bracket is configured for attachment to the left roller rail, said left rail bracket includes a left reel slot;

a right rail bracket is configured for attachment to the right roller rail, said right rail bracket includes a right reel slot;

each said rail bracket includes a rail retention member and said reel slot bracket, a top portion of said rail retention member includes a hook end and a clamp screw, said clamp screw is threadably engaged with said rail retention member, said reel slot bracket is attached to a side portion of said rail retention member, said reel slot bracket includes a reel slot;

a media reel includes a reel tube and a sheet media, a top of said sheet media is secured to said reel tube, a left end of said reel tube is retained in said left reel slot, a right end of said reel tube is retained in said right reel slot; and a bottom media support rests on a support surface, a bottom of said sheet media is secured to said bottom media support.

2. The retractable sports activity device of claim 1, further comprising:

A plurality of attachment clamps are attached along a length of said reel tube to retain said sheet media.

3. The retractable sports activity device of claim 2, further comprising:

a spacer pad is attached to said reel tube between two of said plurality of attachment clamps.

4. The retractable sports activity device of claim 1 wherein:

said bottom media support includes a left support, a right support and a pole, one end of said pole is supported by said left support, an opposing end of said pole is supported by said right support.

5. The retractable sports activity device of claim 4 wherein:

each said support includes a support base and an upright member, a plurality of holes are formed through said upright member to receive opposing ends of said pole.

6. The retractable sports activity device of claim 1 wherein:

an image projector for projecting an image on said sheet media which is a projector screen.

7. A retractable sports activity device for retention on a wall or a ceiling, comprising:

a left bracket is configured for attachment to the wall or the ceiling, said left bracket includes a left reel slot;

a right bracket is configured for attachment to the wall or the ceiling, said right bracket includes a right reel slot;

each said rail bracket includes a rail retention member and said reel slot bracket, a top portion of said rail retention member includes a hook end and a clamp screw, said clamp screw is threadably engaged with said rail retention member, said reel slot bracket is attached to a side portion of said rail retention member, said reel slot bracket includes a reel slot;

a media reel includes a reel tube and a sheet media, a top of said sheet media is secured to said reel tube, a left end of said reel tube is retained in said left reel slot, a right end of said reel tube is retained in said right reel slot; and a bottom media support rests on a support surface, a bottom of said sheet media is secured to said bottom media support.

8. The retractable sports activity device of claim 7, further comprising:

A plurality of attachment clamps are attached along a length of said reel tube to retain said sheet media.

9. The retractable sports activity device of claim 8, further comprising:

a spacer pad is attached to said reel tube between two of said plurality of attachment clamps.

10. The retractable sports activity device of claim 7 wherein:

said bottom media support includes a left support, a right support and a pole, one end of said pole is supported by said left support, an opposing end of said pole is supported by said right pole.

11. The retractable sports activity device of claim 10 wherein:

each said support includes a support base and an upright member, a plurality of holes are formed through said upright member to receive opposing ends of said pole.

12. The retractable sports activity device of claim 7 wherein:

an image projector for projecting an image on said sheet media which is a projector screen.

13. A retractable sports activity device for retention on a left roller rail and a right roller rail of a garage door, comprising:

a left rail bracket is configured for attachment to the left roller rail, said left rail bracket includes a left reel slot;

a right rail bracket is configured for attachment to the right roller rail, said right rail bracket includes a right reel slot;

each said rail bracket includes a rail retention member and said reel slot bracket, a top portion of said rail retention member includes a hook end and a clamp screw, said clamp screw is threadably engaged with said rail retention member, said reel slot bracket is attached to a side portion of said rail retention member, said reel slot bracket includes a reel slot;

a media reel includes a reel tube, a sheet media and a retractable shield unit, a top of said sheet media is secured to said reel tube, said retractable shield unit is secured to a top of said sheet media and to opposing sides of said sheet media unit, a left end of said reel tube is retained in said left reel slot, a right end of said reel tube is retained in said right reel slot, wherein said sheet media is unreeled to deploy said retractable shield unit; and a bottom media support is rests on a support surface, a bottom of said sheet media is secured to said bottom media support.

14. The retractable sports activity device of claim 13 further comprising:

a plurality of attachment clamps are attached along a length of said reel tube to retain said sheet media.

15. The retractable sports activity device of claim 14, further comprising:

a spacer pad is attached to said reel tube between two of said plurality of attachment clamps.

16. The retractable sports activity device of claim 13 wherein:

said bottom media support includes a left support, a right support and a pole, one end of said pole is supported by said left support, an opposing end of said pole is supported by said right pole.

17. The retractable sports activity device of claim 16 wherein:

each said support includes a support base and an upright member, a plurality of holes are formed through said upright member to receive opposing ends of said pole.

* * * * *